US009477246B2

(12) United States Patent
Agarwal et al.

(10) Patent No.: US 9,477,246 B2
(45) Date of Patent: Oct. 25, 2016

(54) LOW DROPOUT VOLTAGE REGULATOR CIRCUITS

(71) Applicant: Texas Instruments Incorporated, Dallas, TX (US)

(72) Inventors: Nitin Agarwal, Karnataka (IN); Suresh Mallala, Karnataka (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 219 days.

(21) Appl. No.: 14/183,739

(22) Filed: Feb. 19, 2014

(65) Prior Publication Data

US 2015/0234404 A1 Aug. 20, 2015

(51) Int. Cl.
*G05F 1/575* (2006.01)
*G05F 3/10* (2006.01)

(52) U.S. Cl.
CPC ..... *G05F 1/575* (2013.01)

(58) Field of Classification Search
CPC ..... G05F 1/56; G05F 1/565; G05F 1/575; G05F 3/10; G11C 5/147
USPC ..... 323/273, 275, 313, 314
See application file for complete search history.

(56) References Cited

U.S. PATENT DOCUMENTS 4,413,226 A * 11/1983 Davies ..... G05F 3/265 323/273
2006/0197513 A1 9/2006 Tang et al.
2007/0188156 A1 8/2007 Eberlein
2008/0303496 A1 12/2008 Schlueter et al.
2013/0162238 A1* 6/2013 Watanabe ..... G05F 3/24 323/313
2014/0239929 A1* 8/2014 Fiocchi ..... G05F 1/575 323/281
2015/0015222 A1* 1/2015 Ivanov ..... G05F 1/56 323/273

FOREIGN PATENT DOCUMENTS

WO 2008087165 A1 7/2008

* cited by examiner

*Primary Examiner* — Gary L Laxton
(74) *Attorney, Agent, or Firm* — John R. Pessetto; Frank D. Cimino

(57) ABSTRACT

In an embodiment, a voltage regulator is disclosed. The voltage regulator circuit includes a switch, a first feedback circuit and a second feedback circuit. The switch is configured to receive an input signal at a first terminal and an error signal at a second terminal and configured to generate an output signal at a third terminal. The first feedback circuit includes a first transistor and a second transistor configured to control the error signal at the second terminal of the switch in response to a difference between the output signal and a reference signal. The second feedback circuit is configured to sense the error signal and generate a tail current at the second node and the fourth node to maintain substantially equal currents in the first transistor and the second transistor, respectively, thereby causing a voltage of the output signal as substantially equal to a voltage of the reference signal.

20 Claims, 3 Drawing Sheets

LOW DROPOUT VOLTAGE REGULATOR CIRCUITS

TECHNICAL FIELD

The present disclosure relates to low dropout voltage regulators.

BACKGROUND

Voltage regulators are configured to provide a regulated output voltage to an electronic device irrespective of variations in input voltage and load current. Various portable electronic devices, such as, for example, certain mobile phones use voltage regulators with low dropout voltages to reduce power consumption of the electronic device. Such voltage regulators are herein referred to, for example, as Low Dropout (LDO) regulators. These voltage regulators are designed with the objective of achieving low quiescent currents at low load currents and accurate voltage outputs across load current range. In usage scenarios, a load offered by an electronic component that utilizes power from the voltage regulators keeps varies continuously. For instance, a current consumption (e.g., a load current) in the electronic component during a standby mode is less than a current consumption in a standard mode. In such scenarios, a system on chip (SOC) switches to a stand-by mode LDO. Such a stand-by mode LDO regulator provides poor regulation of the output voltage; for example, the stand-by mode LDO provides output voltage that is not constant with a variation in the load. In view of the potential benefit of achieving low power consumption in voltage regulators, it is important to maintain accurate LDO output voltage across load current ranges.

SUMMARY

This Summary is provided to introduce a selection of concepts in a simplified form that are further described below in the Detailed Description. This Summary is not intended to identify key or essential features of the claimed subject matter, nor is it intended to be used as an aid in determining the scope of the claimed subject matter.

In an embodiment, a circuit configured to provide regulated output voltage is disclosed. Indeed, in one embodiment, a circuit includes a switch, a first feedback circuit and a second feedback circuit. The switch includes a first terminal, a second terminal and a third terminal. The switch is configured to receive an input signal at the first terminal and an error signal at the second terminal; the switch is also configured to generate an output signal at the third terminal in response to the input signal and the error signal. The first feedback circuit includes a first transistor and a second transistor for controlling the error signal. The first transistor includes a first node, a second node and third node, and the second transistor includes a fourth node, a fifth node and a sixth node. The first node and the second node are coupled to the third terminal of the switch such that each of the first and second nodes is positioned to receive the output signal. The fifth node is positioned to receive a reference signal and the fourth node is coupled to the second terminal such that the fourth node is positioned to control the error signal. The third node and the sixth node are coupled to each other. The first transistor and the second transistor are configured to control the error signal at the second terminal of the switch in response to a difference between the output signal and the reference signal. The second feedback circuit is configured to sense the error signal and generate a tail current at the second node and the fourth node to maintain substantially equal currents in the first transistor and the second transistor, respectively, thereby causing a voltage of the output signal to be substantially equal to a voltage of the reference signal.

In another embodiment, a circuit includes a switch, a first feedback circuit and a second feedback circuit. The switch includes a first terminal, a second terminal and a third terminal. The switch is configured to receive an input signal at the first terminal and an error signal at the second terminal; the switch is also configured to generate an output signal at the third terminal in response to the input signal and the error signal. The first feedback circuit includes a first transistor and a second transistor for controlling the error signal. The first transistor includes a first node, a second node and third node, and the second transistor includes a fourth node, a fifth node and a sixth node. The first node and the second node are coupled to the third terminal of the switch such that each of the first and second nodes is positioned to receive the output signal. The fifth node is positioned to receive a reference signal and the fourth node is coupled to the second terminal such that the fourth node is positioned to control the error signal. The third node and the sixth node are coupled to each other. The first transistor and the second transistor are configured to control the error signal at the second terminal of the switch in response to a difference between the output signal and the reference signal. The circuit also includes a transistor-based diode comprising a seventh node and an eighth node, wherein the seventh node is positioned to receive the input signal and the eighth node is coupled to the fourth node and the second terminal.

In an embodiment, the second feedback circuit is configured to sense the error signal and generate a tail current at the second node and the fourth node so as to maintain substantially equal currents in the first transistor and the second transistor, respectively, thereby causing a voltage of the output signal to be substantially equal to a voltage of the reference signal. The circuit also includes an adaptive filter coupled to the second feedback circuit. The adaptive filter is configured to reduce a gain of the second feedback circuit to less than a gain of the first feedback circuit at operating frequencies greater than a threshold frequency.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to 'one embodiment' or 'an embodiment' means that a particular feature, structure, or characteristic described in connection with the embodiment is included in at least one embodiment of the present technology. The appearance of the phrase 'in one embodiment' in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

Figure 1:
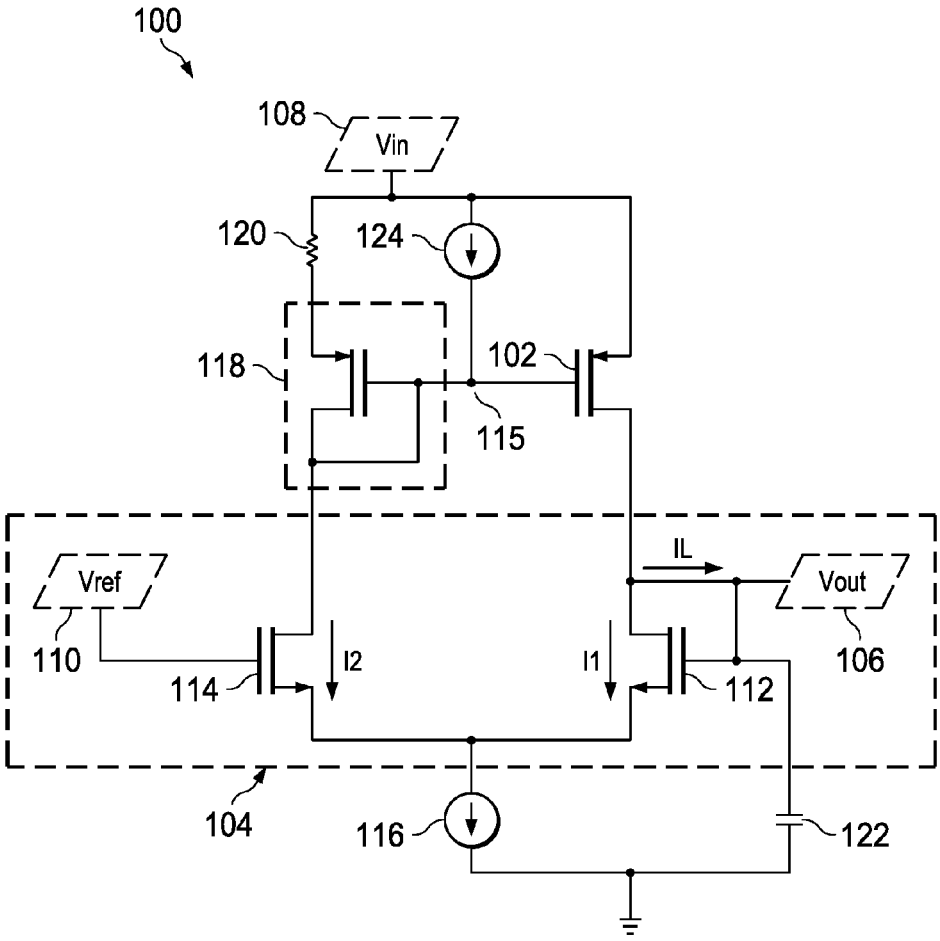
FIG. 1 (PRIOR ART)
FIG. 1 is a circuit diagram illustrating an example low-dropout voltage regulator according to an example scenario.

Pursuant to an example scenario, an example circuit representation of a low-dropout voltage regulator 100 is shown in FIG. 1. The low-dropout voltage regulator 100 is an example of a voltage regulator. The voltage regulator 100 includes a switch 102 that receives an input signal 108 (shown as Vin that is fed to a first terminal of the switch 102) and provides an output signal 106 (shown as Vout taken from a second terminal of the switch 102) in response to the input signal 108. In this example, the voltage regulator 100 includes a feedback circuit 104 that is configured to provide an error signal (at a third terminal of the switch 102) that controls the output signal 106 of the switch 102. The input signal 108 is an unregulated input voltage and the Vout is a regulated output voltage. As shown in FIG. 1, the feedback circuit 104 is a differential amplifier circuit including a first transistor 112 configured to receive the Vout and a second transistor 114 configured to receive a reference voltage 110 (shown as Vref). In an example, the feedback circuit 104 is configured to control a signal at a node 115 (hereinafter referred to as 'error signal') based on difference between the Vout and the Vref. The error signal at the node 115 that is provided to the switch 102 (for example, gate of the switch 102) regulates the Vout to be substantially equal to the Vref. As shown in FIG. 1, the voltage regulator 100 also includes a diode 118 with a degeneration resistor 120 that is coupled between the third terminal of the switch 102 and the input signal 108. The diode 118 is configured to move a pole associated with the switch 102 to a frequency other than operating frequency of the voltage regulator 100. The voltage regulator 100 includes a bias circuit 116 (for example, a current sink) and a bias circuit 124 (for example, a current source) that is configured to provide substantially equal bias currents to the first transistor 112 and the second transistor 114. For instance, the bias circuit 124 provides a constant current Ib/2 and the bias circuit 116 draws a constant current Ib.

The output signal (Vout) 106 is provided to a load (not shown). In some example scenarios, load current may vary based on the different modes of the load. For instance, an example of the load may be a device that has different modes of operations, for example, active mode, power down mode, standby mode, and the like. Accordingly, the current requirement of the load may vary as per different modes of operations of the load. Such changes in load current cause increase/decrease of the Vout 106, and thereby leads to poor DC load regulation. For instance, as the load current increases or decreases in the circuit 100, there will be a difference in the current flowing through the first transistor 112 (for example, I1) and the current flowing through the second transistor 114 (for example, I2). Such difference in the current I1 and I2 is because of the fixed current Ib.

In an example, if the load current increases, a current in the diode 118 increases that causes the current I1 to become less than the current I2. As the current I1 becomes less than the current I2, the Vout 106 decreases. Such phenomenon of decrease in the Vout 106 depending upon the variation of the load current provides a poor DC load regulation in the example voltage regulator 100. Such phenomenon may be understood with the following example. In an example, a sum of I1 and I2 is equal to Ib. For a good DC load regulation (Vref=Vout), I1 should be equal to I2 such that I1=I2=Ib/2. Herein, I1 is the current in the first transistor 112 and I2 is the current in the second transistor 114, Ib is the current flowing in the bias circuit (a current sink) 116 and Ib/2 is the current flowing in bias circuit (the current source) 124. Further, current I2 is equal to a sum of Ib/2 (current in the bias circuit (current source) 124) and IT3 (the current flowing in the diode 118). Accordingly, in order to I1 to be equal to Ib/2, IT3 should be equal to zero current. For a given load current Iload, IT3=IT4/N (N due to resistor degeneration of the diode 118 and ratio between the diode 118 and the switch 102), where IT3 is the current in the diode 118 and IT4 is the current in the switch 102. Currents IT3 and IT4 may be defined as per the following expressions:

$$IT4=(I\text{load}+Ib/2-I\text{error})$$

$$IT3=(I\text{load}+Ib/2-I\text{error})/N$$

Ierror=(Iload+Ib/2)/(N+1), where Ierror is the current through the diode 118. If N is very large of the order of 1000, then IT3 is substantially equal to Iload/N. Accordingly, with the increase in the load current (Iload), IT3 increases. As IT3 increases, I2 also increases as I2 is a sum of IT3 and Ib/2; and I1 reduces in order to maintain the current Ib. Such a mismatch in the I1 and I2, for example, reduction of the I1 causes Vout to reduce, thereby causing a poor DC load regulation in the circuit 100.

Various embodiments of the present technology provide solutions that are capable of regulating output voltage irrespective of changes in the load current to overcome the above described and other limitations, in addition to providing currently available benefits. Various embodiments of the present technology are herein disclosed in conjunction with FIGS. 2-3.

Figure 2:
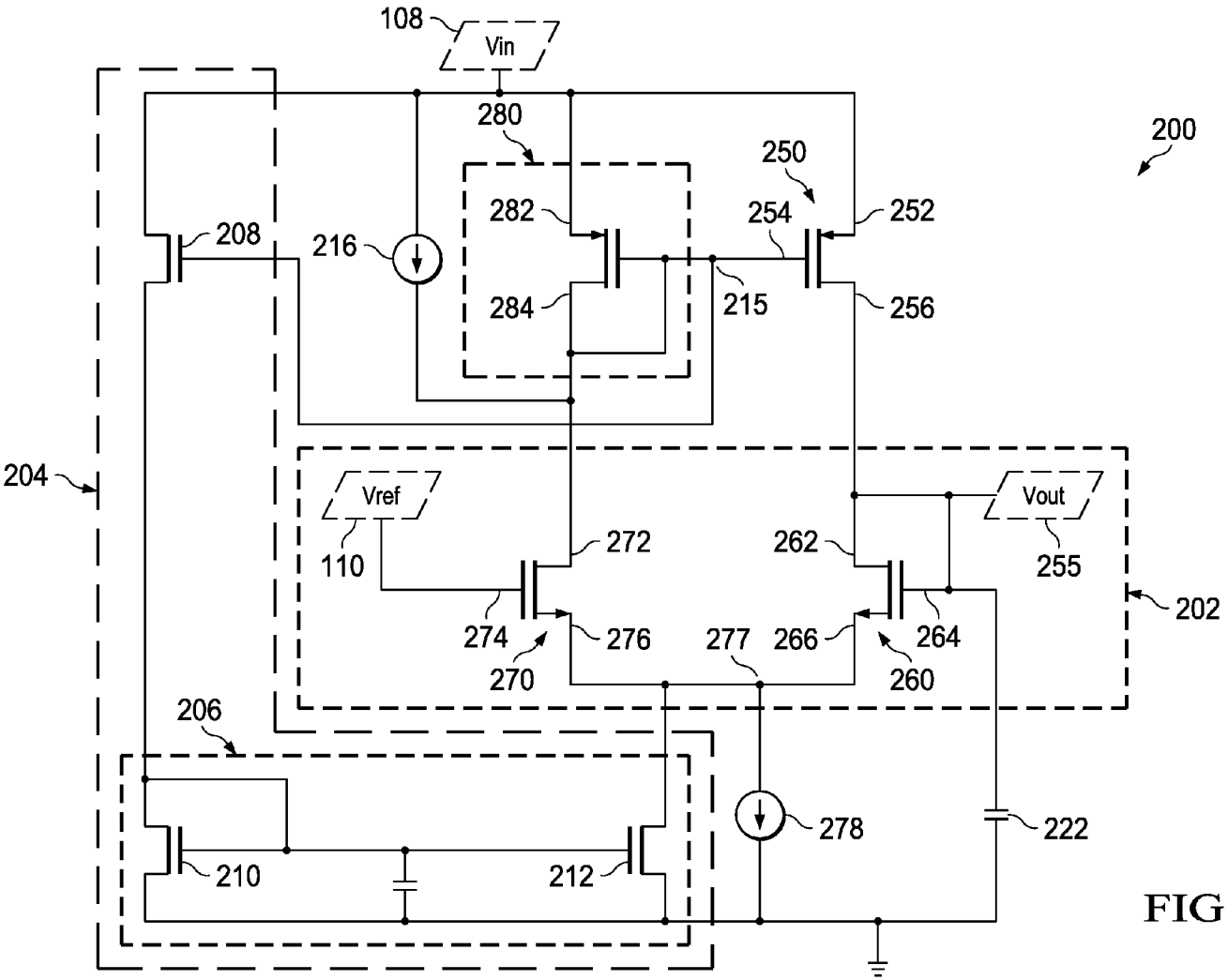
FIG. 2 illustrates a circuit diagram of a voltage regulator according to an embodiment.

FIG. 2 is a circuit diagram illustrating a voltage regulator circuit 200 according to an embodiment of the present technology. The circuit 200 includes a switch, such as the switch 250. An example of the switch 250 is the switch 102 described with reference to FIG. 1. In an embodiment, the switch 250 receives an input signal 108 (see, Vin) at a terminal 252 (first terminal) and an error signal at a terminal 254 (second terminal), and provides output signal 255 (shown as Vout) at a terminal 256 (third terminal) of the switch 250 in response to the input signal 108 and the error signal received at a node 215 that is connected to the terminal 254 of the switch 250. A current flowing in the switch 250 is controlled by the error signal fed to the terminal 254 of the switch 250. In an example embodiment, the switch 250 may be a MOS transistor, such as a NMOS transistor or a PMOS transistor. In alternate embodiments, the switch 250 may be configured as other Field Effect Transistor (FET) and Bipolar Junction Transistor (BJT).

In the example embodiment, the voltage regulator 200 includes a first feedback circuit 202 for controlling the error signal. In this example embodiment, the first feedback circuit 202 includes a differential amplifier formed by a transistor 260 (a first transistor) and a transistor 270 (a second transistor). In an example embodiment, the transistors 260 and 270 can be NMOS or PMOS transistors depending upon the configuration of the switch 250. As shown in FIG. 2, the transistor 260 includes nodes 262, 264 and 266, and the transistor 270 includes nodes 272, 274 and 276.

The node 262 (first node) and the node 264 (second node) are coupled to the terminal 256 of the switch 250 to receive the output signal 255. The node 274 (the fifth node) of the transistor 270 is configured to receive the reference signal 110 (shown as Vref); and the node 272 (fourth node) is coupled to the second terminal 254 (or the node 215) to control the error signal. The node 266 (the third node) and the node 276 (the sixth node) are coupled to each other (see, node 277) and are coupled with the ground through a first bias circuit 278. The transistors 260 and 270 are configured to control the error signal at the second terminal 254 of the switch 250 in response to a difference between the Vout and the Vref.

In an embodiment, the circuit 200 includes the first bias circuit 278 a second bias circuit 216 and a transistor-based diode 280 (hereinafter referred as the diode 280). In an embodiment, the first bias circuit 278 is coupled between a node 277 and ground, and the first bias circuit 278 is configured to provide bias current to transistors 260 and 270. In an embodiment, the first bias circuit 278 is configured to maintain a constant total current flowing in transistors 260 and 270 and to maintain a constant DC bias in the transistors 260 and 270. Herein, the first bias circuit 278 is shown as a current sink circuit that sinks a constant current from the transistors 260 and 270, however, it should be noted that the first bias circuit 278 can be configured in a variety of ways, such as by utilizing a specific circuit element such as a transistor or combination of circuit elements such as amplifiers, diodes, resistors, transistors, and the like. In an embodiment, the diode 280 is coupled between the first node 252 and the second node 254 of the switch 250. The diode 280 includes a node 282 (seventh node) positioned to receive the input signal 108 (see, Vin) and a node 284 (eighth node) that is coupled to the node 272 (fourth node) and the terminal 254. In an embodiment, the diode 280 is configured to compensate a pole in the transfer function of the circuit 200. For instance, the switch 250 introduces a pole in the circuit transfer function that renders the circuit 200 unstable at higher load conditions. In an embodiment, the diode 280 is configured to move the pole associated with the switch 250 to a frequency other than the operating frequency of the circuit 100 to make the circuit 200 stable at high load currents. In this embodiment, the diode 280 is implemented by a transistor with two terminals tied together. In an embodiment, the switch 250 is geometrically sized 'N' times size of the diode 280, the current flowing in the switch 250 is 'N' times current flowing in the diode 280.

The circuit 100 includes the second bias circuit 216 coupled between the terminal 252 of the switch 250 and the node 272 of the transistor 270. In an embodiment, when the load current is low, the diode 280 is powered OFF and provides substantially zero bias current for the transistors 260 and 270 in the first feedback circuit 202. In this embodiment, the second bias circuit 216 is configured to bias currents in the transistors 260 and 270 under no-load conditions. For instance, at very low load currents, the diode 280 connected to switch 250 goes into off state and there is no bias current in the transistors 260 and 270. Accordingly, a current source (the second bias circuit 216) in parallel to the diode 280 and a current sink (the first bias circuit 278) are added as the tail of the transistors 260 and 270 to maintain a good DC load regulation at zero load currents. In an embodiment, current in the second bias circuit 216 is fixed and provides half of the bias current that is drawn by the first bias circuit 278 to maintain the DC load regulation at zero load currents. The circuit 200 includes a capacitor 222 that is coupled between the node 264 of the transistor 260 and ground. The capacitor 222 is configured to hold the output signal 255 that is fed to the load during load transients (not shown).

In this example embodiment, the voltage regulator circuit 200 includes a second feedback circuit 204 that is configured to maintain substantially equal currents in the transistor 260 and 270 (I1 and I2, respectively), that are otherwise not equal in the circuit 100 with variation in load current. Accordingly, the voltage regulator circuit 200 provides a good DC load regulation. An example embodiment of the second feedback circuit 204 is shown in FIG. 2.

In an embodiment, the second feedback circuit 204 is coupled between the second node 254 of the switch 250 and the node 277. In an embodiment, the second feedback circuit 204 is configured to compensate for the current through diode 280 due to increase/decrease in load current such that currents in the transistors 260 and 270 are equal thereby regulating the output voltage 255.

In an embodiment, the second feedback circuit 204 is configured to sense the error signal that is fed to the node 254 of the switch 250. The error signal is proportional to the increase/decrease of the load current. For example, when the load current increases or decreases, the currents in the transistors 260 and 270 (I1 and I2, respectively) change and hence the error signal also changes and accordingly, the current sensed by the second feedback circuit 204 also changes. In an embodiment, the second feedback circuit 204 includes a current mirror circuit 206, and a transistor 208 (third transistor) that forms another current mirror circuit with the diode 280.

In an example embodiment, the transistor 208 and the diode 280 form a current mirror circuit. The current mirror circuit 206 includes a transistor 210 (fourth transistor) and a transistor 212 (fifth transistor) that are geometrically sized to compensate for the change in load current. The transistor 210 is coupled to the transistor 208 and the transistor 212 is coupled to the third node 266 and the sixth node 276 (for example, the node 277 that is coupled to the nodes 266 and 276) to sink a tail current from the transistors 260 and 270. The transistor 210 is configured to source current from the transistor 208 and the transistor 212 is configured to mirror a current in the transistor 210 as the tail current (of the transistors 260 and 270) that is substantially twice of a current through the transistor 210. In this embodiment, the transistor 212 is sized twice the transistor 210 and the transistor 208 is configured to receive the sensed current (for example, a current sensed from the node 215 due to the error signal). It should be noted that the twice of the current flowing in the diode 280 is drawn as tail current in the transistor 212, as current in the diode 280 is mirrored in the transistor 208 and a twice of the current in the transistor 208 is mirrored in the transistor 212. In this embodiment, the tail current (for example, 2*IT3) compensates for increase/decrease in current flowing in transistors 260 and 270, thereby regulating the Vout irrespective of the load current variation.

Figure 3:
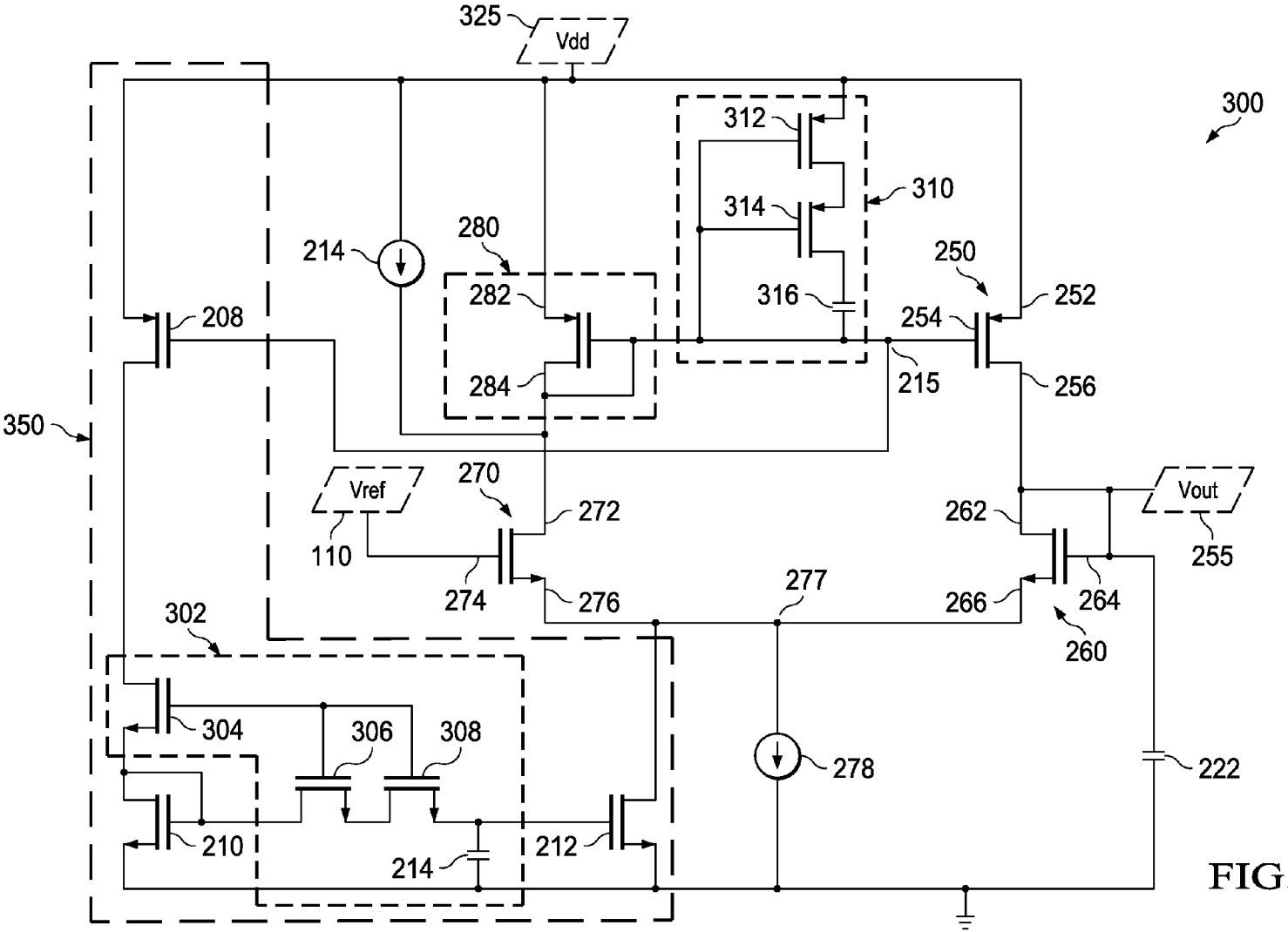
FIG. 3 is a circuit diagram of a voltage regulator according to another embodiment.

FIG. 3 illustrates a circuit diagram of a low-dropout voltage regulator circuit 300 according to an embodiment. It should be noted that the details of the circuit 300 are provided merely by way of illustration, and that other embodiments may contain fewer or more components, and corresponding interconnections. FIG. 3 represents the circuit 300 that may be a portion of an integrated circuit. As shown in FIG. 3, the circuit 300 includes the switch 250, a differential amplifier circuit such as the first feedback circuit 202, the first bias circuit 278, the transistor-based diode 280 and a second bias circuit 350. The switch 250, the first feedback circuit 202, the first bias circuit 278 and the diode 280 are already described in reference to FIG. 2, and hence their description is omitted for the sake of brevity. Herein in this embodiment, the switch 250 receives a power supply input (Vdd) 325 in place of the input signal (Vin) 108 as shown in FIG. 2, and an output signal 355 is regulated in response to the reference signal 110.

The circuit 300 includes the second feedback circuit 350 that includes circuit elements present in the second feedback circuit 206 along with additional circuit elements. For example, the second feedback circuit 350 includes a transistor such as the third transistor 208, a current mirror circuit such as the current mirror circuit 206 (formed by the transistors 210 and 212), an adaptive filter 302. In an embodiment, the adaptive filter 302 is coupled between gate terminals of the transistors 210 and 212 to improve the stability of the circuit 300 at high operating frequencies. It should be noted that a negative feedback loop gain provided by the first feedback circuit 202 should be greater than a positive feedback loop gain provided by the second feedback circuit 350 to maintain the circuit 300 stable at higher operating frequencies. In an embodiment, the adaptive filter 302 is a low pass filter that attenuates high frequency signals associated with a sensed signal (of the sensed current from the node 215) and mirrored through the transistor 208 at higher operating frequencies. Such attenuation of the sensed signal at high operating frequency reduces the positive feedback loop gain of the second feedback circuit 350 and makes the circuit 300 stable at high operating frequencies. In an embodiment, the adaptive filter 302 adapts to the changes in load current and cut off frequency of the adaptive filter 302 varies with the load current.

In this embodiment, the adaptive filter 302 includes a transistor 304, a first resistor 306 (configured as a MOS transistor), a second resistor 308 (configured as a MOS transistor) and a capacitor 214. In an embodiment, the transistor 304 is configured to receive the sensed current (from the second node 254 of the switch 250 through the transistor 208) and provide a voltage associated with the sensed current across the resistors 306 and 308. It should be noted that the resistors 306 and 308 are illustrated for example purposes and the circuit 300 includes fewer or more resistors in the adaptive filter 302. In this embodiment, the resistors 306 and 308 are implemented as NMOS transistors. Alternatively, the resistors 306 and 308 can also be implemented using PMOS transistors or a combination of PMOS transistors and NMOS transistors. The adaptive filter 302 can also implemented be in a variety of ways using specific circuit elements or a combination of circuit elements such as, resistors, capacitors, amplifiers, transistors, diodes, and the like.

As shown in FIG. 3, the circuit 300 includes a filter circuit 310 coupled between the node 252 of the switch 250 and the node 254 of the switch 250. In an embodiment, the filter circuit 310 includes transistors 312, 314 and capacitor 316 configured to shift a pole associated with the diode 280 coupled to the switch 250 to a frequency that is higher than the unity gain-bandwidth of the circuit 300. The filter circuit 310 shown in FIG. 3 is merely an example, and may be configured in a variety of ways using specific circuit elements or a combination of circuit elements such as, resistors, capacitors, amplifiers, transistors, diodes, and the like.

In an embodiment, transfer function of the circuit 300 is expressed as:

$$H(s) = \frac{-gmp\{(N-2)gm1 \cdot gmt - 2 \cdot gmt \cdot g_L\}(1 + S \cdot \omega z)}{(gmt + SCx)\{gm1 + 2g_L + S \cdot 2 \cdot C_L\}(gmp + SC_p)}$$

where, $$\omega z = \frac{NC_x gm1 - 2gmtC_L}{(N-2) \cdot gm1 \cdot gmt - 2gmt \cdot g_L}$$

In this embodiment, gmp is the transconductance of the diode 280 and the transistor 208. The switch 250 is sized 'N' times the diode 280 and transconductance of the switch 250 is N*gmp. The transconductance of the transistor 270 is gml and gmt is total transconductance of the current mirror circuit 206 and the adaptive filter circuit 302 that is given by:

$$gmt = \frac{gm2}{1 + gm2 \cdot Rx}$$

where gm2 is the transconductance of the transistor 210 in the current mirror circuit 206 and $R_x$ is the resistance offered by the resistors 306 and 308 in the adaptive filter circuit 302 that is configured as a low pass filter and $g_L$ is the transconductance offered by the load (not shown). In an embodiment, $C_L$ and $C_x$ are capacitances of the capacitor 222 (load capacitor) and the capacitor 214 (filter capacitance), respectively. In an embodiment, the negative feedback loop gain provided by the first feedback circuit 202 is greater than the positive feedback loop gain provided by the second feedback circuit 350 to maintain the circuit 300 stable. The condition for ωz to be in the LHP or for better phase margin (stability of the circuit 300) is given by the expression:

$$\frac{N * gm1}{2C_L} \geq \frac{gmt}{C_x}$$

that can be achieved by selecting the values of gmt and $C_x$ and other values

Without in any way limiting the scope, interpretation, or application of the claims appearing below, effects of one or more of the example embodiments disclosed herein is to provide a circuit capable of providing good DC load regulation with variations in load current. The circuit is scalable to higher load currents without increase in quiescent current. The second feedback circuit adaptively increases the quiescent current with increase in load current. The second feedback circuit also ensures that the output voltage is regulated and accurate across load current change. The stability of the circuit is considerably increased by utilizing the first filter circuit and the adaptive filter circuit. The first filter circuit is configured to move a pole associated with the diode coupled to the switch to a frequency other than the operating frequency of the circuit. The adaptive filter circuit ensures that the positive feedback loop gain of the circuit associated with the second feedback circuit is always lower that the negative feedback loop gain associated with the first feedback circuit and thereby maintaining the circuit stable and removing ringing at higher operating frequencies and increased load currents.

It should be noted that reference throughout this specification to features, advantages, or similar language does not imply that all of the features and advantages should be or are in any single embodiment. Rather, language referring to the features and advantages is understood to mean that a specific feature, advantage, or characteristic described in connection with an embodiment is included in at least one embodiment of the present technology. Thus, discussions of the features and advantages, and similar language, throughout this specification but do not necessarily, refer to the same embodiment.

Various embodiments of the present disclosure, as discussed above, are practiced with steps and/or operations in a different order, and/or with hardware elements in configurations which are different than those which are disclosed. Therefore, although the technology has been described based upon these example embodiments, it is noted that certain modifications, variations, and alternative constructions are apparent and well within the spirit and scope of the technology.

Although various example embodiments of the present technology are described herein in a language specific to structural features and/or methodological acts, the subject matter defined in the appended claims is not necessarily limited to the specific features or acts described above. Rather, the specific features and acts described above are disclosed as example forms of implementing the claims.

What is claimed is:

1. A circuit for providing regulated output voltage, the circuit comprising:

a switch comprising a first terminal, a second terminal and a third terminal, the switch configured to receive an input signal at the first terminal and an error signal at the second terminal, and the switch further configured to generate an output signal at the third terminal in response to the input signal and the error signal;

a first feedback circuit comprising a first transistor and a second transistor, the first transistor comprising a first node, a second node and third node, and the second transistor comprising a fourth node, a fifth node and a sixth node, the first node and the second node coupled to the third terminal of the switch such that the first node and the second node are positioned to receive the output signal, the fifth node positioned to receive a reference signal and the fourth node coupled to the second terminal such that the first feedback circuit is configured to control the error signal, the third node and the sixth node coupled to each other, and the first transistor and the second transistor configured to control the error signal at the second terminal of the switch in response to a difference between the output signal and the reference signal; and a second feedback circuit configured to sense the error signal and generate a tail current at the second node and the fourth node so as to maintain substantially equal currents in the first transistor and the second transistor, respectively, thereby causing a voltage of the output signal to be substantially equal to a voltage of the reference signal.

2. The circuit of claim 1, further comprising a transistor-based diode comprising a seventh node and an eighth node, the seventh node positioned to receive the input signal and the eighth node coupled to the fourth node and the second terminal.

3. The circuit of claim 2, wherein the second feedback circuit comprises:

a third transistor coupled to the second terminal of the switch, the third transistor configured to mirror current of the transistor-based diode; and a current mirror circuit comprising a fourth transistor and a fifth transistor, the fourth transistor coupled to the third transistor and the fifth transistor coupled to the third node and the sixth node to thereby sink a tail current from the first transistor and the second transistor, the fourth transistor configured to source current from the third transistor and the fifth transistor configured to mirror a current in the fifth transistor as the tail current in the fifth transistor that is substantially twice of the current sourced from the third transistor in the fourth transistor.

4. The circuit of claim 3, wherein the fifth transistor has a geometric size that is substantially twice a geometric size of the fourth transistor.

5. The circuit of claim 3, wherein the switch is a Metal Oxide Semiconductor (MOS) transistor.

6. The circuit of claim 5, wherein the transistor-based diode is geometrically sized smaller than the switch.

7. The circuit of claim 3, wherein the tail current in the fifth transistor is twice of a current flowing in the transistor-based diode.

8. The circuit of claim 2, further comprising a first bias circuit coupling the third node and the sixth node to a ground, the first bias circuit configured to sink a first tail current from the first transistor and the second transistor.

9. The circuit of claim 8, further comprising a second bias circuit configured to provide a bias current in the second transistor.

10. The circuit of claim 9, wherein the first tail current is approximately twice the bias current.

11. A circuit for providing regulated output voltage, the circuit comprising:

a switch comprising a first terminal, a second terminal and a third terminal, the switch configured to receive a power supply input at the first terminal and an error signal at the second terminal, and the switch further configured to generate an output signal at the third terminal in response to the power supply input and the error signal;

a first feedback circuit comprising a first transistor and a second transistor, for controlling the error signal, the first transistor comprising a first node, a second node and third node, and the second transistor comprising a fourth node, a fifth node and a sixth node, the first node and the second node coupled to the third terminal of the switch such that the first node and the second node are positioned to receive the output signal, the fifth node configured to receive a reference signal and the fourth node coupled to the second terminal such that the first feedback circuit is configured to control the error signal, the third node and the sixth node coupled to each other, and the first transistor and the second transistor configured to control the error signal at the second terminal of the switch in response to a difference between the output signal and the reference signal;

a transistor-based diode comprising a seventh node and an eighth node, the seventh node positioned to receive the input signal and the eighth node coupled to the fourth node and the second terminal;

a second feedback circuit configured to sense the error signal and generate a tail current at the second node and the fourth node so as to maintain substantially equal currents in the first transistor and the second transistor, respectively, thereby causing a voltage of the output signal to be substantially equal to a voltage of the reference signal; and an adaptive filter coupled to the second feedback circuit, the adaptive filter configured to reduce a gain of the second feedback circuit to less than a gain of the first feedback circuit at operating frequencies greater than a threshold frequency.

12. The circuit of claim 11, further comprising a filter circuit coupled to the second terminal, the filter circuit configured to move a pole associated with the transistor-based diode outside a unity gain-bandwidth of the circuit.

13. The circuit of claim 11, wherein the adaptive filter comprises at least one resistor and a capacitor.

14. The circuit of claim 11, wherein the second feedback circuit comprises:

a third transistor coupled to the second terminal of the switch, the third transistor configured to mirror current of the transistor-based diode; and a current mirror circuit comprising a fourth transistor and a fifth transistor, the fourth transistor coupled to the third transistor and the fifth transistor coupled to the third node and the sixth node to thereby sink a tail current from the first transistor and the second transistor, the fourth transistor configured to source current from the third transistor and the fifth transistor configured to mirror a current in the fifth transistor as the tail current in the fifth transistor that is substantially twice of the current sourced from the third transistor in the fourth transistor.

15. The circuit of claim 14, wherein the fifth transistor has a geometric size that is substantially twice a geometric size of the fourth transistor.

16. The circuit of claim 14, wherein the switch is a Metal Oxide Semiconductor (MOS) transistor.

17. The circuit of claim 16, wherein the transistor-based diode is geometrically sized smaller than the switch.

18. The circuit of claim 14, wherein the tail current in the fifth transistor is twice of a current flowing in the transistor-based diode.

19. The circuit of claim 14, further comprising a first bias circuit coupling the third node and the sixth node to a ground supply, the first bias circuit configured to sink a first tail current from the first transistor and the second transistor.

20. The circuit of claim 19, further comprising a second bias circuit configured to provide a bias current in the second transistor.

* * * * *